US009395648B2

(12) United States Patent
Suzuki

(10) Patent No.: US 9,395,648 B2
(45) Date of Patent: Jul. 19, 2016

(54) TONER ACCOMMODATING CONTAINER AND IMAGE FORMING APPARATUS

(71) Applicant: CANON KABUSHIKI KAISHA, Tokyo (JP)

(72) Inventor: Kazushi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/743,241

(22) Filed: Jun. 18, 2015

(65) Prior Publication Data

US 2015/0286162 A1 Oct. 8, 2015

Related U.S. Application Data

(63) Continuation of application No. 14/311,080, filed on Jun. 20, 2014, now Pat. No. 9,086,653.

(30) Foreign Application Priority Data

Jun. 24, 2013 (JP) ..... 2013-131662

(51) Int. Cl.

| | |
|---|---|
| ***G03G 21/12*** | (2006.01) |
| ***G03G 15/20*** | (2006.01) |
| ***G03G 15/08*** | (2006.01) |
| ***G03G 21/00*** | (2006.01) |

(52) U.S. Cl.

CPC ..... *G03G 15/0865* (2013.01); *G03G 15/0877* (2013.01); *G03G 15/0886* (2013.01); *G03G 21/007* (2013.01); *G03G 21/12* (2013.01); *G03G 15/0879* (2013.01)

(58) Field of Classification Search

CPC .. G03G 15/0877; G03G 21/007; G03G 21/12
USPC ..... 399/123, 358–360
See application file for complete search history.

(56) References Cited

U.S. PATENT DOCUMENTS

| | | | | |
|---|---|---|---|---|
| 8,406,653 | B2 * | 3/2013 | Okamoto | G03G 21/1633 399/110 |
| 2012/0051817 | A1 * | 3/2012 | Wakimoto | G03G 21/105 399/360 |

* cited by examiner

*Primary Examiner* — Hoang Ngo
(74) *Attorney, Agent, or Firm* — Canon USA Inc. IP Division

(57) ABSTRACT

In connection with movement of an opening-closing member when a toner accommodating container is attached to the image forming apparatus, the urging direction of an urging member relative to the opening-closing member changes from a direction that causes the opening-closing member to close an opening portion to a direction that causes the opening-closing member to open the opening portion. By using the urging force of the urging member that acts in the direction that causes the opening-closing member to open the opening portion, the toner accommodating container is pulled into the image forming apparatus.

14 Claims, 17 Drawing Sheets

TONER ACCOMMODATING CONTAINER AND IMAGE FORMING APPARATUS

CROSS-REFERENCE TO RELATED APPLICATIONS

This application is a Continuation of U.S. application Ser. No. 14/311,080 filed Jun. 20, 2014 which claims priority from Japanese Patent Application No. 2013-131662 filed Jun. 24, 2013, all of which are hereby incorporated by reference herein in their entirety.

BACKGROUND OF THE INVENTION

1. Field of the Invention

The present invention relates to an image forming apparatus that forms images by an electro-photographic method, such as a copying machine, a printer, a facsimile apparatus or a multifunction peripheral.

2. Description of the Related Art

A multi-color or full-color electrophotographic image forming apparatus includes a cleaning unit that removes toner remaining on a transfer belt. As a cleaning unit, a configuration in which toner on a transfer belt is scraped with a cleaning blade (a cleaning member) that is in press-contact with the transfer belt has been put into practical use. The toner removed by the cleaning unit is conveyed by a toner conveyance unit to a toner discharge opening that is provided at a downstream side in the toner conveying direction. The downstream side of the toner discharge opening is provided with a toner accommodating container that houses toner. Toner flows from the toner discharge opening of the cleaning unit into an opening that is formed in the toner accommodating container, so that the toner is contained in the toner accommodating container.

A toner accommodating container as mentioned above is known to have a construction in which the toner accommodating container is attachable to and detachable from the apparatus main body so that when the toner accommodating container is full, a user or a service person can replace the container with a new toner accommodating container. Furthermore, a construction is proposed in which when the toner accommodating container is being attached or detached, the opening of the toner accommodating container is closed with a shutter (i.e., an opening-closing member) so that toner will not leak out of the opening.

Japanese Patent Application Laid-Open No. 2002-169441 discusses a toner accommodating container that includes an urging member that urges an opening-closing member in a direction that closes the opening of the toner accommodating container. In this construction, the urging member certainly allows the opening-closing member to close the opening when the toner accommodating container is detached from the apparatus main body.

However, in Japanese Patent Application Laid-Open No. 2002-169441, the urging member of the toner accommodating container always urges the opening-closing member in a direction that closes the opening. Therefore, in the construction discussed in this document, in order to open the opening of the toner accommodating container when attaching the toner accommodating container to the apparatus main body, it is necessary to place the opening-closing member in contact with the cleaning member and move the opening-closing member in a direction that opens the opening portion against the force caused by the urging member. Hence, in the construction discussed in Japanese Patent Application Laid-Open No. 2002-169441, at the time of attaching the toner accommodating container to the apparatus main body, the force of the urging member acts as a reaction force against the force attaching the toner accommodating container to the apparatus main body, giving rise to possibility of reducing the ease of the operation of attaching the toner accommodating container to the apparatus main body.

SUMMARY OF THE INVENTION

Accordingly, the present invention is directed to improving the ease of the operation of attaching a collected toner container to an apparatus main body while ensuring that the opening of the toner accommodating container is closed with an opening-closing member urged by an urging member when the toner accommodating container is detached from the apparatus main body.

According to an aspect of the present invention, a toner accommodating container attachable to and detachable from an image forming apparatus container includes an accommodation portion that contains toner; an opening; an opening-closing member movable to open and close the opening; and an urging member that urges the opening-closing member. The toner accommodating container is attachable to and detachable from the image forming apparatus in a state in which the opening-closing member is urged by the urging member in a direction that causes the opening-closing member to close the opening. When the toner accommodating container is attached to the image forming apparatus, an urging direction of the urging member relative to the opening-closing member is changed from the direction that causes the opening-closing member to close the opening portion to a direction that causes the opening-closing member to open the opening portion in connection with movement of the opening-closing member while the toner accommodating container is being attached to the image forming apparatus, and the toner accommodating container is pulled into a main body of the image forming apparatus by using the urging force of the urging member that acts in the direction that causes the opening-closing member to open the opening portion.

Furthermore, according to another aspect of the present invention, an image forming apparatus includes an apparatus main body; a toner accommodating container including an accommodation portion that contains toner, an opening configured to allow toner to move between the apparatus main body and the accommodation portion, an opening-closing member that opens and closes the opening, and an urging member that urges the opening-closing member, the toner accommodating container being attachable to and detachable from the apparatus main body in a state in which the opening-closing member is urged by the urging member in a direction that causes the opening-closing member to close the opening. When the toner accommodating container is attached to the apparatus main body, an urging direction of the urging member relative to the opening-closing member is changed from the direction that causes the opening-closing member to close the opening portion to a direction that causes the opening-closing member to open the opening portion in connection with movement of the opening-closing member while the toner accommodating container is being attached to the apparatus main body, and the toner accommodating container is pulled into an apparatus main body by using the urging force of the urging member that acts in the direction that causes the opening-closing member to open the opening portion.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

It is to be noted that the dimensions, materials, shapes, relative positions, etc. of component parts mentioned in conjunction with the following exemplary embodiments are to be changed as appropriate according to various conditions and the construction of the apparatus to which the present invention is applied. Therefore, the scope of the present invention is not limited to what are mentioned below, unless otherwise specified.

Figure 1:
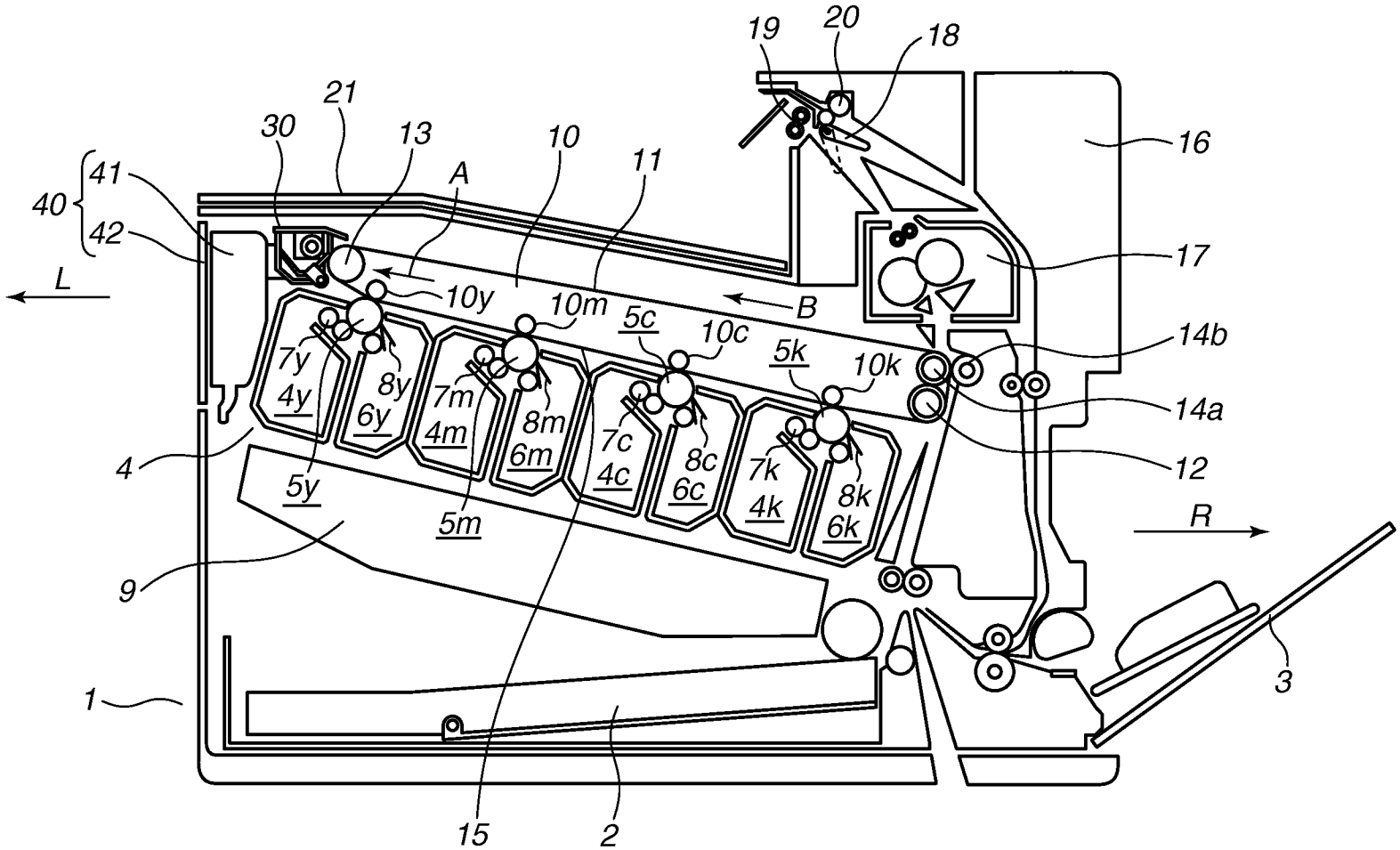
FIG. 1 is a sectional view of an image forming apparatus according to a first exemplary embodiment of the present invention.

Hereinafter, a first exemplary embodiment of the present invention will be described. FIG. 1 is a schematic diagram showing an example of a color image forming apparatus. The image forming apparatus 1 is capable of forming an image on a transfer material, such as a recording sheet of paper or an overhead projector (OHP) sheet, by an electrophotographic method, according to signals from an external appliance, such as a personal computer connected to the image forming apparatus 1 so as to allow communication therebetween.

In a lower portion of the image forming apparatus (e.g., a printer) 1, a cassette 2 is housed so that the cassette 2 can be drawn out. A manual feed unit 3 is provided on the right side in FIG. 1. Transfer materials placed and stored in the cassette 2 or the manual feed unit 3 are separated and fed, one at a time.

The image forming apparatus 1 includes, as image forming units, process cartridges 4*y*, 4*m*, 4*c*, 4*k* (process cartridge 4) that correspond to colors of yellow, magenta, cyan and black, respectively. Within the process cartridge 4 there are provided charging members 6*y*, 6*m*, 6*c*, 6*k* that uniformly charge photosensitive drums 5*y*, 5*m*, 5*c*, 5*k* (photosensitive drums 5) that are image carriers. Furthermore, the process cartridge 4 has therein development rollers 7*y*, 7*m*, 7*c*, 7*k* that develop electrostatic latent images into toner images, and cleaning blades 8*y*, 8*m*, 8*c*, 8*k* (photosensitive member cleaning blades 8) that remove residual toner that remains on the photosensitive drums 5. The development rollers 7 are configured to contact and separate from the photosensitive drums 5. Bringing the development rollers 7 into and out of contact with the photosensitive drums 5 according to images increase the service life of each development roller 7. The process cartridges 4*y*, 4*m*, 4*c*, 4*k* (process cartridge 4) are attachable to and detachable from the image forming apparatus 1. Although the image forming units are described as the process cartridges whose members related to image forming are integrally attachable to and detachable from a main body of the image forming apparatus 1, the members related to image forming may be separately attached and detached.

A scanner unit 9 (charging unit) is provided below the process cartridge 4. The scanner unit 9 forms electrostatic latent images on the photosensitive drums 5 by irradiating the photosensitive drums 5 with laser beams on the basis of image information. Furthermore, a transfer unit is provided above the process cartridge 4.

A transfer unit in this exemplary embodiment is an intermediate transfer unit 10 that includes primary transfer rollers 10*y*, 10*m*, 10*c*, 10*k*, an intermediate transfer belt 11, a drive roller 12, a tension roller 13, and a secondary transfer counter roller 14*a*. The intermediate transfer belt 11 is a loop-shaped belt configured to transfer toner images formed on the photosensitive drums 5 onto a transfer material, and is stretched between the drive roller 12, the tension roller 13, and the secondary transfer counter roller 14*a*. The tension roller 13 is urged in the direction of an arrow A in FIG. 1 by an urging unit (not shown) so as to give a predetermined tension to the intermediate transfer belt 11. Then, the drive roller 12 is driven by an electric motor (not shown) or the like to rotate so that the intermediate transfer belt 11 rotates at a predetermined speed in the direction B shown by an arrow in FIG. 1.

In this exemplary embodiment, the intermediate transfer unit 10 further includes a cleaning unit 30 that removes toner adhering to the intermediate transfer belt 11. The cleaning unit 30 is disposed upstream of a primary transfer portion formed by the photosensitive drum 5*y* and the primary transfer roller 10*y*, in a moving direction of the intermediate transfer belt 11 (the direction B shown by the arrow in FIG. 1). Furthermore, the cleaning unit 30 is disposed downstream of a secondary transfer portion formed by the secondary transfer counter roller 14*a*, and a secondary transfer roller 14*b* that is a secondary transfer member. Furthermore, the image forming apparatus 1 includes a collected toner container 40 that contains the toner collected by the cleaning unit 30, as a toner accommodating container.

In order to reduce the size of the apparatus 1, the intermediate transfer unit 10 is arranged such that a primary transfer surface 15 of the intermediate transfer unit 10 formed on a side facing the photosensitive drums 5 is inclined. The primary transfer surface 15 of the intermediate transfer unit 10 is arranged to incline so that a cleaning unit 30 of the primary transfer surface 15 is placed higher and a secondary transfer portion (secondary transfer member side) of the primary transfer surface 15 is placed lower.

Figure 2:
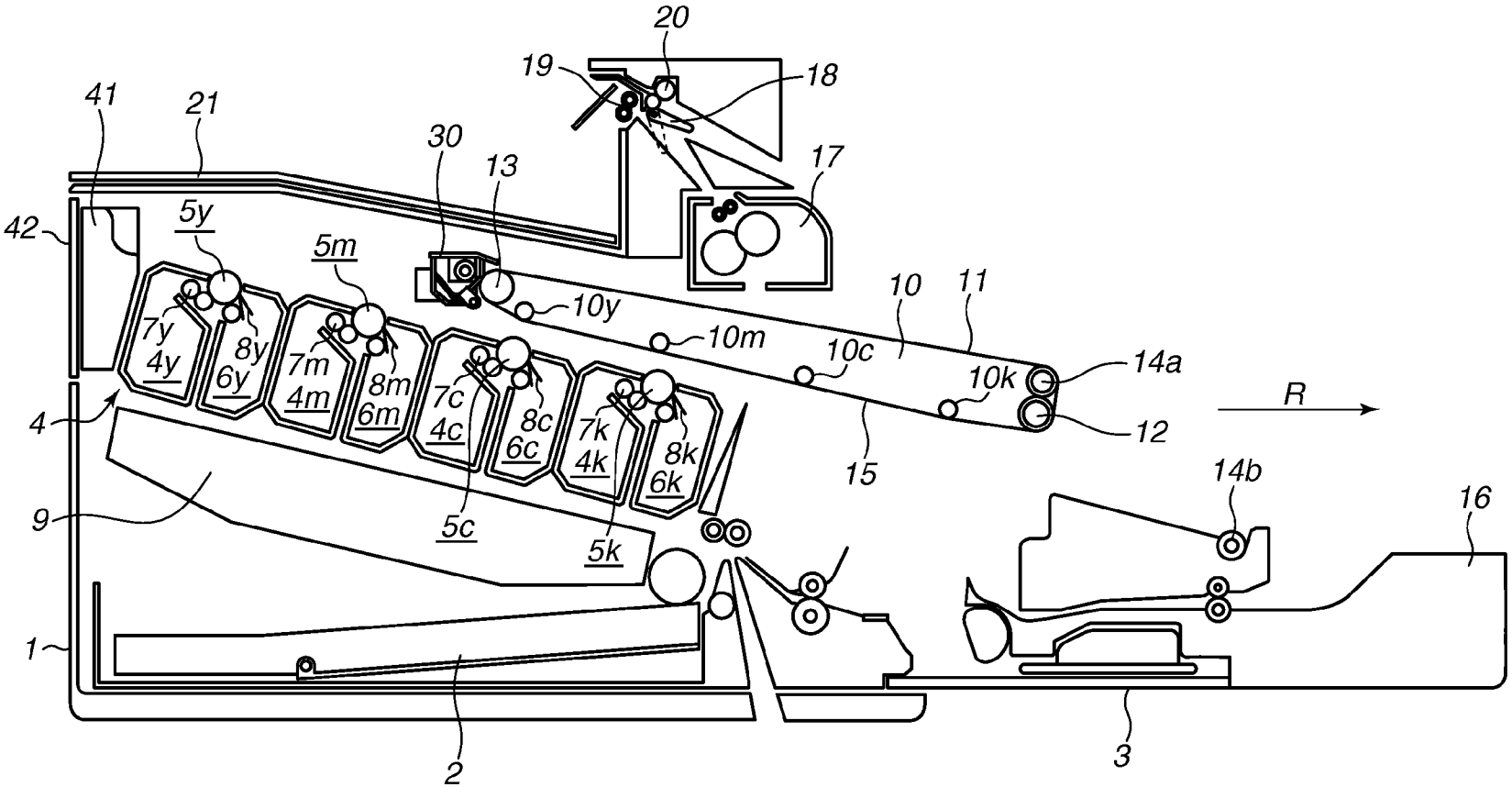
FIG. 2 is a schematic diagram illustrating a state in which an intermediate transfer unit is being drawn out of a main body of the apparatus.

Furthermore, since the intermediate transfer belt 11 is a wear-and-tear item, the intermediate transfer unit 10 is attachable to and detachable from the apparatus main body. FIG. 2 is a schematic diagram illustrating a state in which the intermediate transfer unit 10 is removed from the apparatus main body. The intermediate transfer unit 10 is detachable and attachable from and to the apparatus main body, in a direction R shown in FIGS. 1 and 2. The detaching and attaching operation is performed by opening a door 16, pulling the intermediate transfer unit 10 out in the direction R shown by an arrow R in FIG. 2, replacing it with a new intermediate transfer unit 10, and then closing the door 16.

The collected toner container 40 in this exemplary embodiment can be detached from the image forming apparatus 1, in a direction L in FIG. 1. A construction for attaching and detaching the collected toner container 40 will be described below.

Toner images on the photosensitive drums 5 developed by the development rollers 7 are primarily transferred to the intermediate transfer belt 11. The primary transfer is performed in the primary transfer portion that is formed by the primary transfer rollers 10*y*, 10*m*, 10*c*, 10*k* and the photosensitive drums 5. In the primary transfer portion, the transfer of toner to the intermediate transfer belt 11 is performed by applying a voltage of positive polarity to the primary transfer rollers 10*y*, 10*m*, 10*c*, 10*k* and utilizing the potential difference of the rollers from surfaces of the photosensitive drums 5 that have been charged in negative polarity.

A toner image primarily transferred to the intermediate transfer belt 11 is then transferred to a transfer material in a secondary transfer portion that is formed by the secondary transfer counter roller 14*a* and the secondary transfer roller 14*b*. Then, the transfer material passes through a fixation unit 17 that performs fixation. After that, the conveyance path is switched by a two-sided flapper 18 so that the transfer material is conveyed to either a discharge roller pair 19 or a switchback roller pair 20. If conveyed to the switchback roller pair 20 side, the transfer material is inverted and conveyed back by the switchback roller pair 20, so that the transfer material passes through the secondary transfer portion 14 and the fixation unit 17 again and is conveyed to the discharge roller pair 19 side. After passing between the pair of discharge rollers 19, the transfer material is discharged onto a transfer material stacking portion 21.

Figure 3:
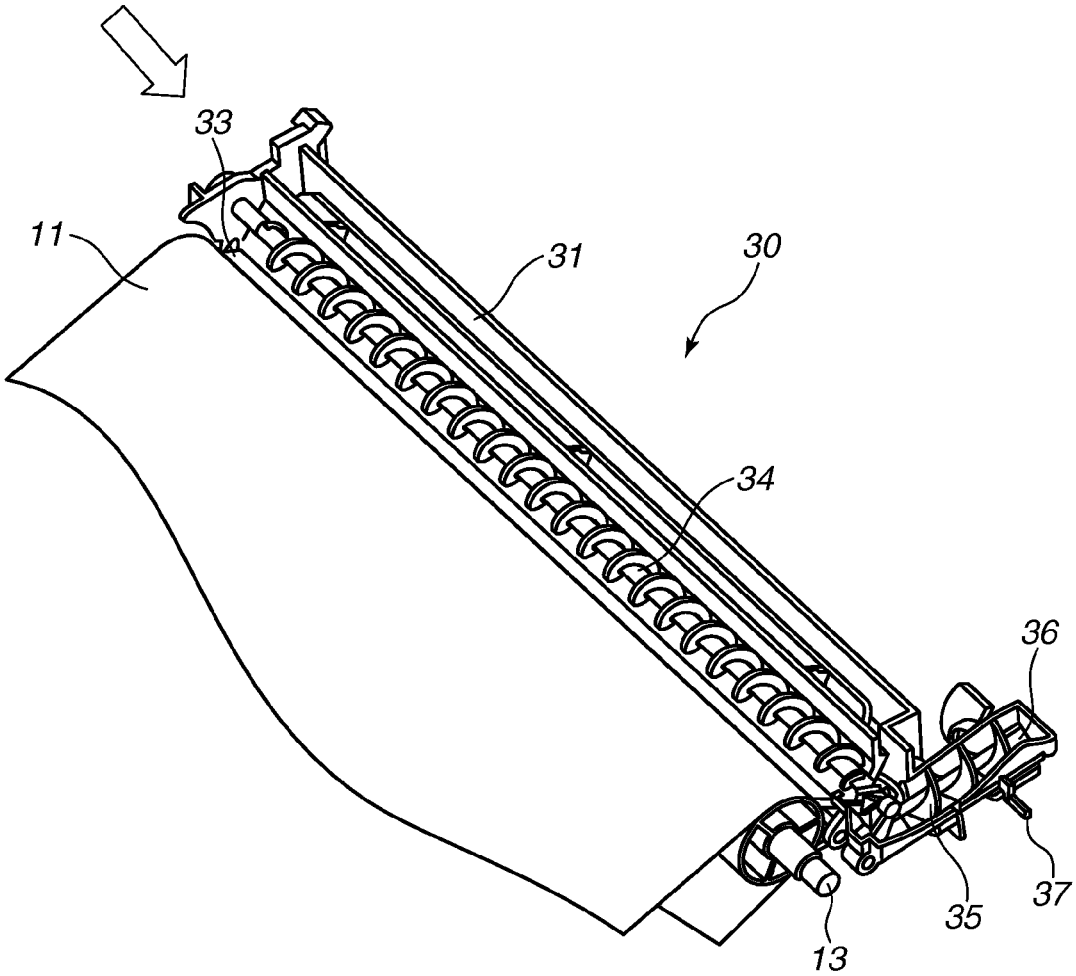
FIG. 3 is a perspective view of a cleaning unit and an intermediate transfer belt, taken from a reverse side of the apparatus.
Figure 4:
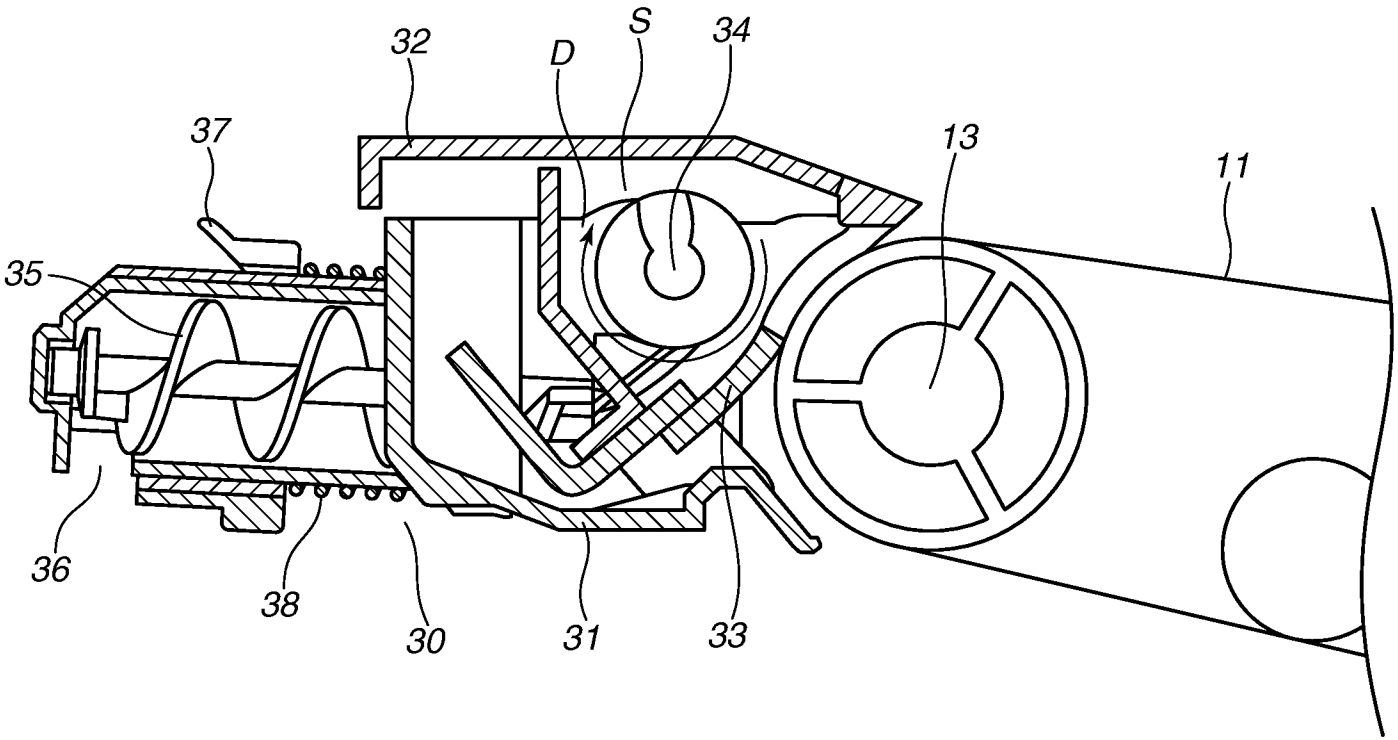
FIG. 4 is a sectional view illustrating the cleaning unit and the intermediate transfer belt, taken from the direction of an arrow in FIG. 3.

Next, the cleaning unit 30 will be described in detail. FIG. 3 is a perspective view illustrating the cleaning unit 30 and the intermediate transfer belt 11. FIG. 4 is a sectional view illustrating the cleaning unit 30 and the intermediate transfer belt 11 viewed from the direction of an arrow in FIG. 3.

As shown in FIGS. 3 and 4, the cleaning unit 30 includes a first cover 31, a second cover 32, a cleaning blade 33, a toner conveying screw 34, a toner discharge screw 35, a toner discharge opening 36, a slide member 37, and a spring 38. As shown in FIG. 3, the cleaning blade 33, which is a cleaning member, is provided to be in contact with the intermediate transfer belt 11 in a direction orthogonal to the moving direction of the intermediate transfer belt 11 (in the lengthwise direction of the cleaning blade 33). The cleaning blade 33 is made of a deformable elastic rubber. The width of the cleaning blade 33 in its lengthwise direction is greater than or equal to the width of a transfer material of maximum-size on which the image forming apparatus 1 can form an image. The cleaning blade 33 is pressed to contact with the intermediate transfer belt 11 to remove toner from the intermediate transfer belt 11. Furthermore, in order to obtain a desired linear pressure that enables removal of toner, it is a common practice to press the cleaning blade 33 against various rollers provided on the inner side of the intermediate transfer belt 11. In this exemplary embodiment, the cleaning blade 33 is pressed against the tension roller 13.

As shown in FIG. 4, the toner conveying screw 34 is disposed in a space S that is defined by the intermediate transfer belt 11, the second cover 32, and the cleaning blade 33. The toner conveying screw 34 is rotatably held at its both ends by the first cover 31. Via a drive gear (not shown) provided on an end of the toner conveying screw 34, drive force is transmitted to the toner conveying screw 34 so as to rotate the toner conveying screw 34 in a toner conveying direction (the direction of an arrow D shown in FIG. 4).

The toner scraped from the intermediate transfer belt 11 by the cleaning blade 33 begins to accumulate on the cleaning blade 33. Then, the toner contacts the toner conveying screw 34, and is thereby conveyed to an end portion side (toner discharge screw 35 side) in the lengthwise direction. The toner discharge screw 35 receives toner from the toner conveying screw 34, and conveys the toner to a toner discharge opening 36 side. If the toner discharge opening 36 is always exposed or open, toner leaks out of the toner discharge opening 36 and stains the inside of the image forming apparatus 1 when the collected toner container 40 is detached or attached. In order to prevent the leak, the cleaning unit 30 is equipped with a slide member 37 that closes the toner discharge opening 36, and the spring 38, which is an urging member for the slide member 37. In this exemplary embodiment, the slide member 37 is capable of contacting the collected toner container 40. When the collected toner container 40 is attached to the apparatus main body, the slide member 37 detracts from the toner discharge opening 36, against the spring force of the spring 38. When the collected toner container 40 is detached from the image forming apparatus 1, the slide member 37 closes the toner discharge opening 36 under the urging force of the spring 38. In this exemplary embodiment, the urging force of the spring 38 is set to 150 [gf].

Figure 5:
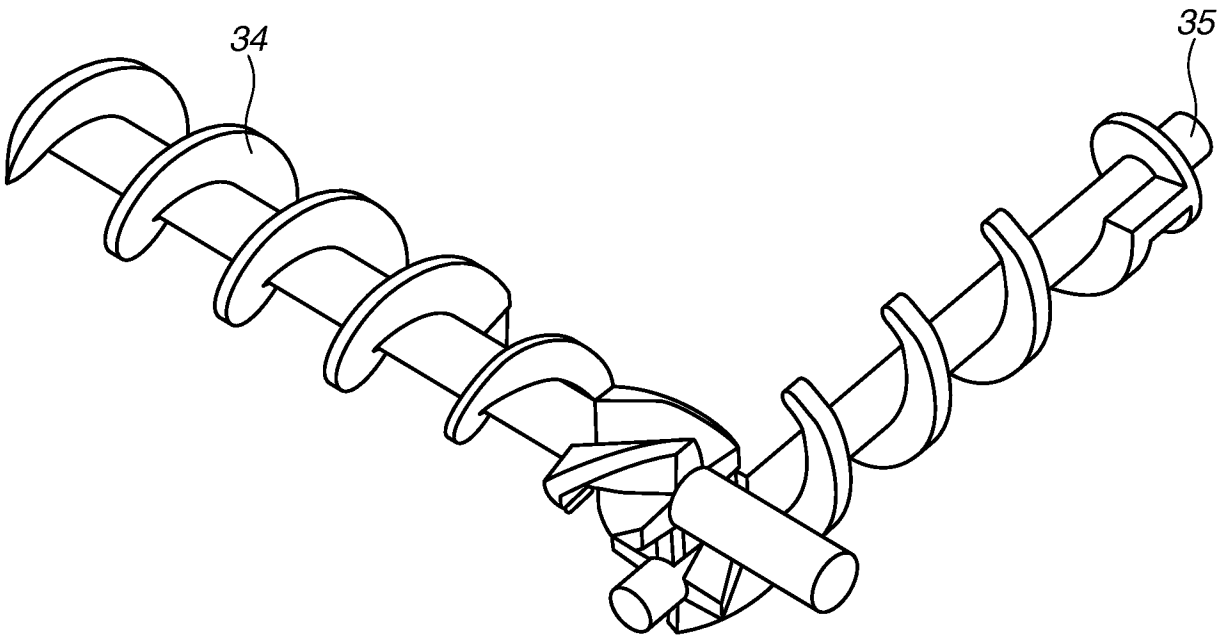
FIG. 5 is a schematic diagram illustrating how a toner discharge screw is driven.

FIG. 5 is a schematic diagram illustrating the driving of the toner discharge screw 35. As shown in FIG. 5, the toner discharge screw 35 is disposed directly under the toner conveying screw 34 and orthogonally to the toner conveying screw 34. The downstream side of the toner conveying screw 34 and an upstream side end of the toner discharge screw 35 in the toner conveying direction are provided with helical-gear-shaped vanes of a helical angle of 45°. By rotating these vanes, the transmission of drive force and the conveyance of toner between the two screws 34 and 35 are performed. Although the transmission of drive force of the toner discharge screw 35 is performed by the helical-gear-shaped vanes having a helical angle of 45°, the driving connection device at the toner passing portion is not limited to this construction.

Figure 6:
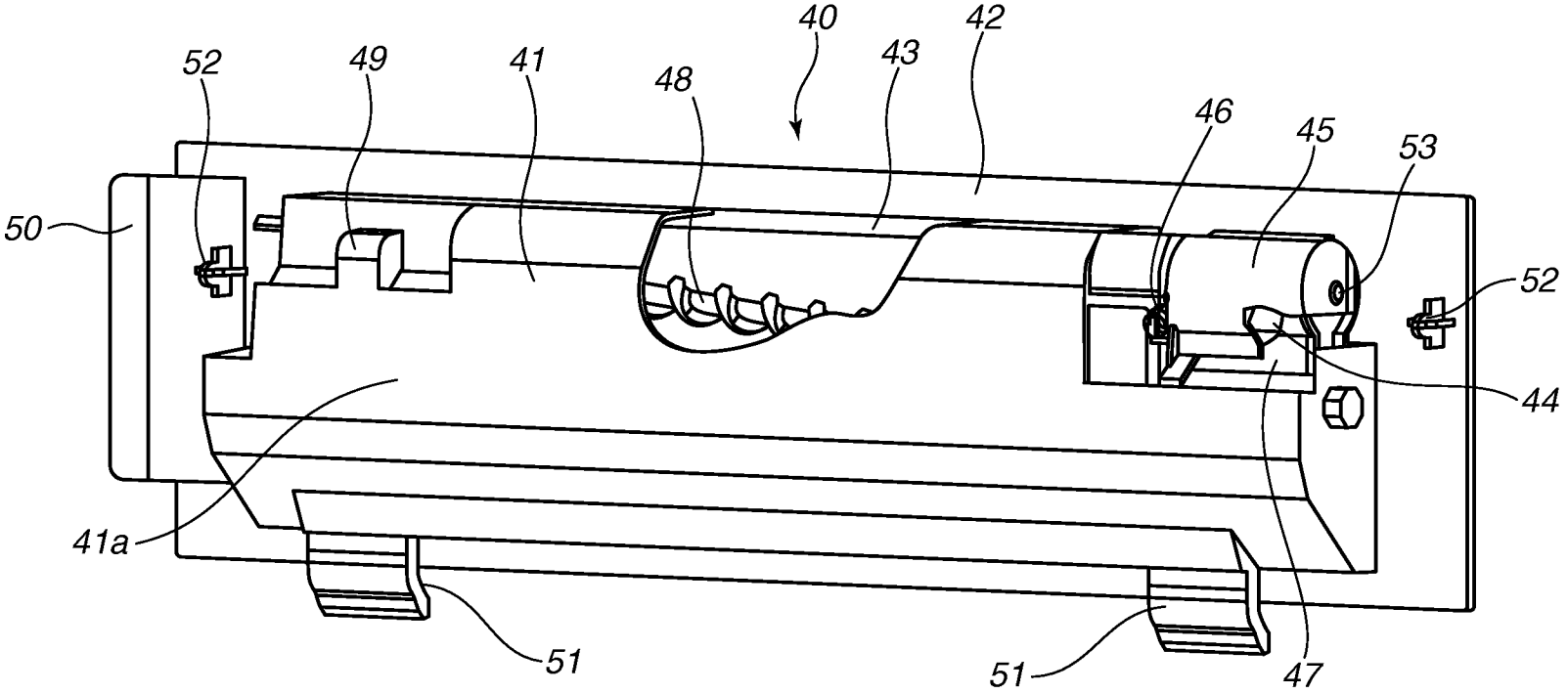
FIG. 6 is a diagram illustrating a toner accommodating container that has been removed from the image forming apparatus of the first exemplary embodiment.

Next, the collected toner container 40 will be described. FIG. 6 is a diagram illustrating the collected toner container 40 removed from the image forming apparatus 1.

As shown in FIG. 6, the collected toner container 40 is integrally constructed such that an exterior cover 42 that forms a portion of an exterior cover of the image forming apparatus 1 is fixed to an accommodation portion 41 for containing toner. A seal member 43 that is an elastic member made of polyurethane is sandwiched between the accommodation portion 41 and the exterior cover 42 so as to prevent leakage of toner. In FIG. 6, a portion of a side wall surface 41*a* of the accommodation portion 41 is omitted in order to illustrate the seal member 43.

The collected toner container 40 includes an opening configured to pass toner between the apparatus main body and the collected toner container 40, and a movable shutter 45 that is an opening-closing member for opening and closing the opening. In this exemplary embodiment, the opening is a toner inlet opening 44 that is an inlet through which toner flows from the apparatus main body into the accommodation portion 41. The collected toner container 40 further includes a spring 46 that is a member for urging the shutter 45. The spring 46 used herein is an extension coil spring. Furthermore, an end side of the exterior cover 42 in its lengthwise direction is provided with the toner inlet opening 44, and the other end side is provided with a handle 50. The handle 50 is used at the time of attaching the collected toner container 40 to the image forming apparatus 1 or detaching it from the image forming apparatus 1.

A lower portion of the accommodation portion 41 is provided with guide protrusions 51 (protrusion portions) that can engage with the apparatus main body. The guide protrusions 51 are used as guides when the collected toner container 40 is attached to or detached from the apparatus main body. Bosses 52 are provided on two ends of the exterior cover 42. The bosses 52 are fit to cutout portions (not shown) of the apparatus main body to define the position of the collected toner container 40 to the apparatus main body in a lengthwise direction. The toner inlet opening 44 is formed at an upper end of the side wall surface 41*a* of the accommodation portion 41. A perimeter of the toner inlet opening 44 is covered with a seal member 47. The shutter 45 is provided at an outer side of the seal member 47. The seal member 47 also uses an elastic member made of polyurethane. The seal member 47 closes the gap between the accommodation portion 41 and the shutter 45 to suppress leakage of toner. The shutter 45 in FIG. 6 is partially omitted in order to illustrate the toner inlet opening 44 and the seal member 47.

Figure 7:
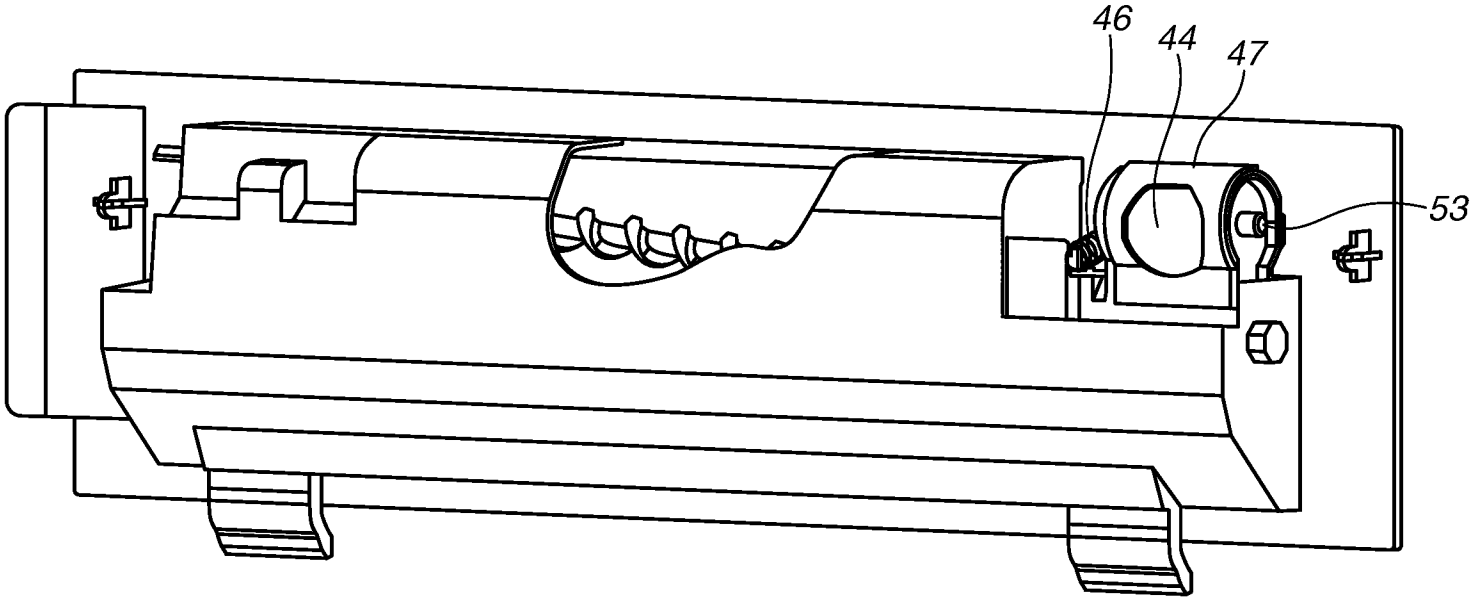
FIG. 7 is a diagram illustrating a toner inlet opening and a seal member in the first exemplary embodiment.

FIG. 7 is a perspective view in which the shutter 45 is eliminated from the illustration of FIG. 6 in order to illustrate the seal member 47 and the toner inlet opening 44. The shutter 45 remains closed due to the urging force of the spring 46 when the collected toner container 40 is not attached to the image forming apparatus 1. The shutter 45 pivots about a boss 53 (pivot axis) under the urging force of the spring 46 to open and close the toner inlet opening 44.

Furthermore, the collected toner container 40 is equipped with a filled-state detection window 49 (FIG. 6) configured to detect that the toner accommodation portion 41 is filled up, and a toner breaking screw 48 (FIG. 6) that is a conveyance member configured to convey toner within the toner accommodation portion 41.

Figure 8:
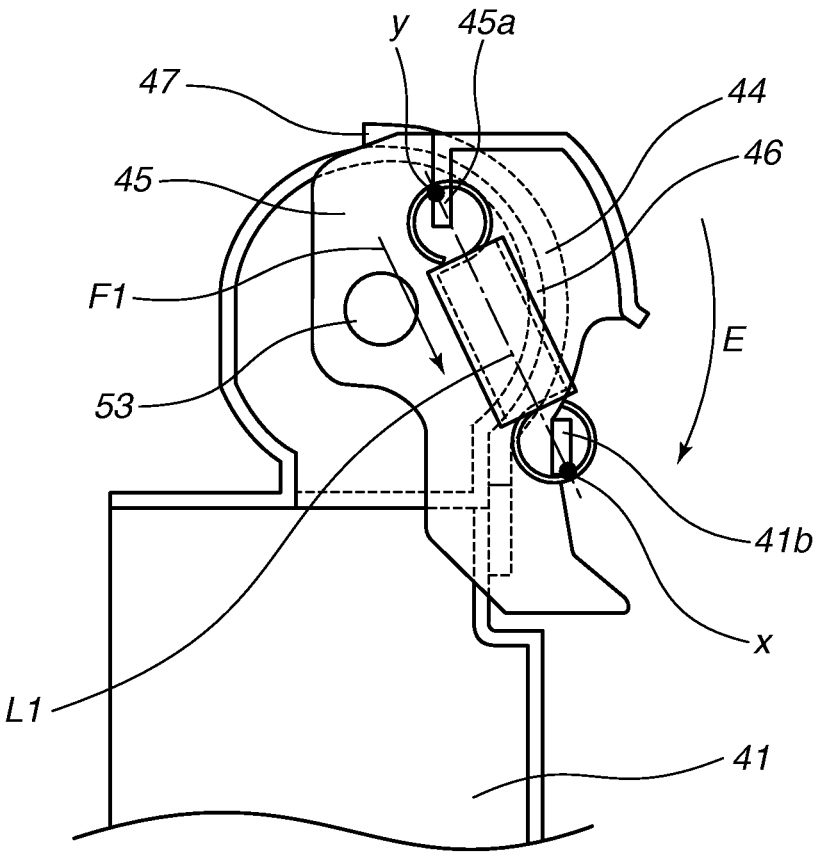
FIG. 8 is a diagram illustrating the direction in which an urging member urges an opening-closing member when the toner inlet opening is closed by the opening-closing member in the first exemplary embodiment.

FIG. 8 is a sectional view of the collected toner container 40 near the shutter 45, and is a diagram for illustrating the urging direction of the spring 46 when the toner inlet opening 44 is closed by the shutter 45. As shown in FIG. 7, the spring 46 is hooked on a lug 41*b* that is a first latching portion provided in the toner accommodation portion 41 and a lug 45*a* that is a second latching portion provided on the shutter 45. When the toner inlet opening 44 is closed by the shutter 45, a straight line L1 defined by a point (x) at which the lug 41*b* contacts the spring 46 and a point (y) at which the spring 46 contacts the lug 45*a* is located on the right side of the boss 53 in FIG. 8. Therefore, the urging force F1 of the spring 46 (the pulling force acting on the shutter 45) keeps acting on the shutter 45 in a direction that causes the shutter 45 to close the toner inlet opening 44 (the direction of an arrow E in FIG. 8). In other words, the urging direction of the spring 46 relative to the shutter 45 in the state shown in FIG. 8 is the direction E.

Therefore, even if a user or a service person, when replacing the collected toner container 40, makes an operation mistake and inadvertently topples the collected toner container 40, the shutter 45 does not open and therefore toner does not leak. In the exemplary embodiment, a setting of the urging force F1=500 [gf] is made.

Figure 9:
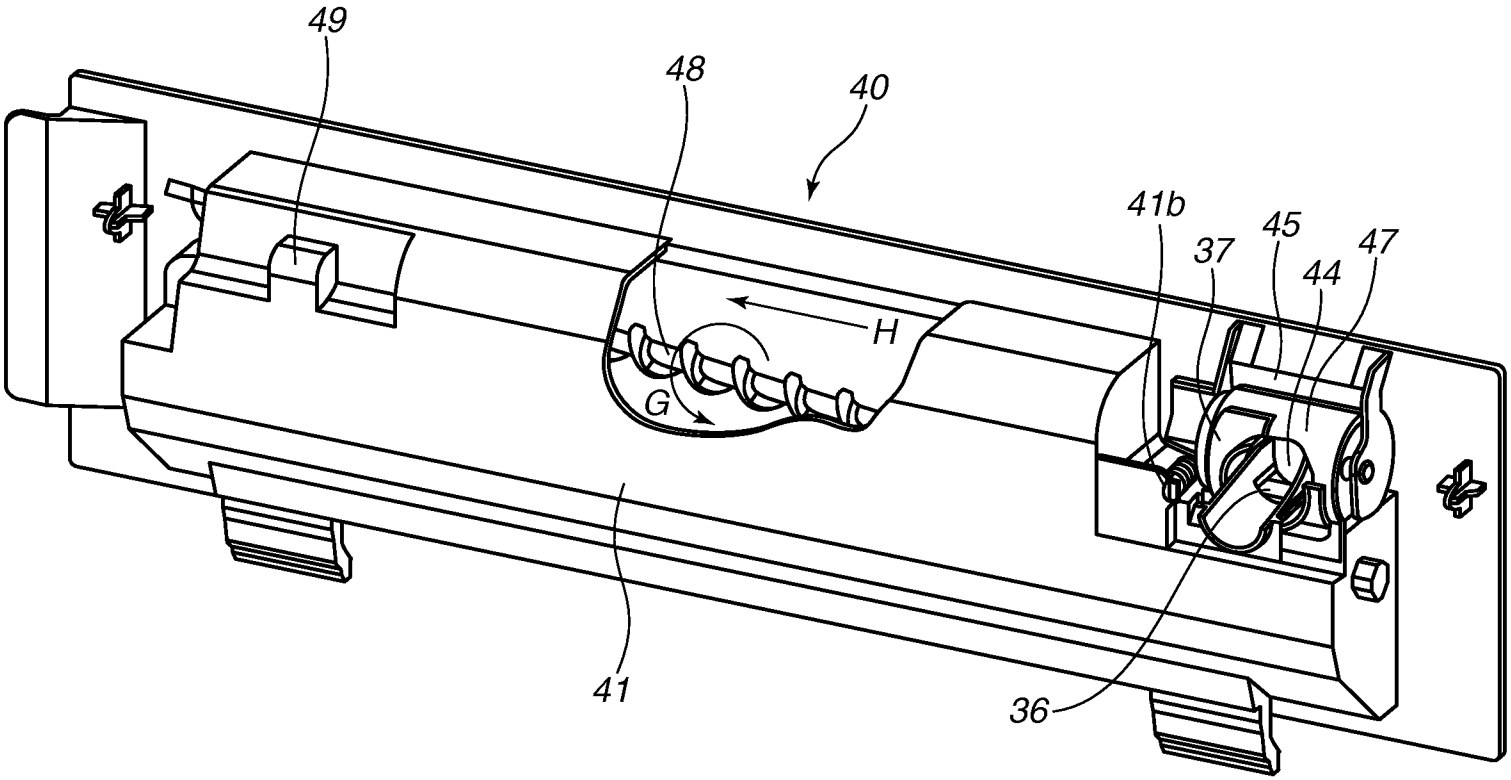
FIG. 9 is a diagram illustrating the toner accommodating container attached to the image forming apparatus in the first exemplary embodiment.

FIG. 9 is an illustrative diagram illustrating the collected toner container 40 attached to the image forming apparatus 1 in contrast to FIGS. 6 and 7. As shown in FIG. 9, when the collected toner container 40 is attached to the image forming apparatus, the slide member 37 is retracted, and the toner discharge opening 36 of the cleaning unit 30 and the toner inlet opening 44 of the collected toner container 40 are connected to each other. The toner discharge opening 36 extends into the collected toner container 40 through the toner inlet opening 44, thus making an overlapping connection. Furthermore, the seal member 47 closes the gap between the slide member 37 and the toner inlet opening 44 to suppress the leak of toner.

The toner having flown into the collected toner container 40 from the toner discharge opening 36 accumulates on a bottom of the collected toner container 40, starting from around a lower periphery of the toner discharge opening 36. The toner breaking screw 48 is provided directly under the toner discharge opening 36. Drive force is transmitted from the toner conveying screw 34, via idler gears (not shown) disposed within the image forming apparatus 1, to a drive gear (not shown) that is provided on an outside wall surface of the collected toner container 40 such that the toner breaking screw 48 rotates in a toner conveying direction (the direction of an arrow G shown in FIG. 9). When toner begins to contact the toner breaking screw 48 as the accumulation of toner progresses, the toner breaking screw 48 conveys toner to an end side opposite to the toner inlet opening 44 (in the direction of an arrow H in FIG. 9).

An upper portion of the accommodation portion 41 near the opposite end thereof in the width direction of the intermediate transfer belt 11 is provided with the filled-state detection window 49. The image forming apparatus side is provided with a detection sensor (not shown). When the filled-state detection window 49 is covered with toner, the sensor blocks light, thus detecting that the accommodation portion 41 is full. Then, an operating panel presents display to indicate the filled state, informing a user or a service person that the collected toner container is full. When informed that the collected toner container 40 is full, the user or service person carries out an operation of replacing the collected toner container 40.

Because the collected toner container 40 is freely detachable from and attachable to the apparatus main body in the direction of the arrow L shown in FIG. 1, so that the collected toner container 40 can easily be replaced. After the collected toner container 40 is drawn out, an empty collected toner container 40 is attached to the apparatus main body, so that the image forming apparatus can continue to be used.

Figure 10:
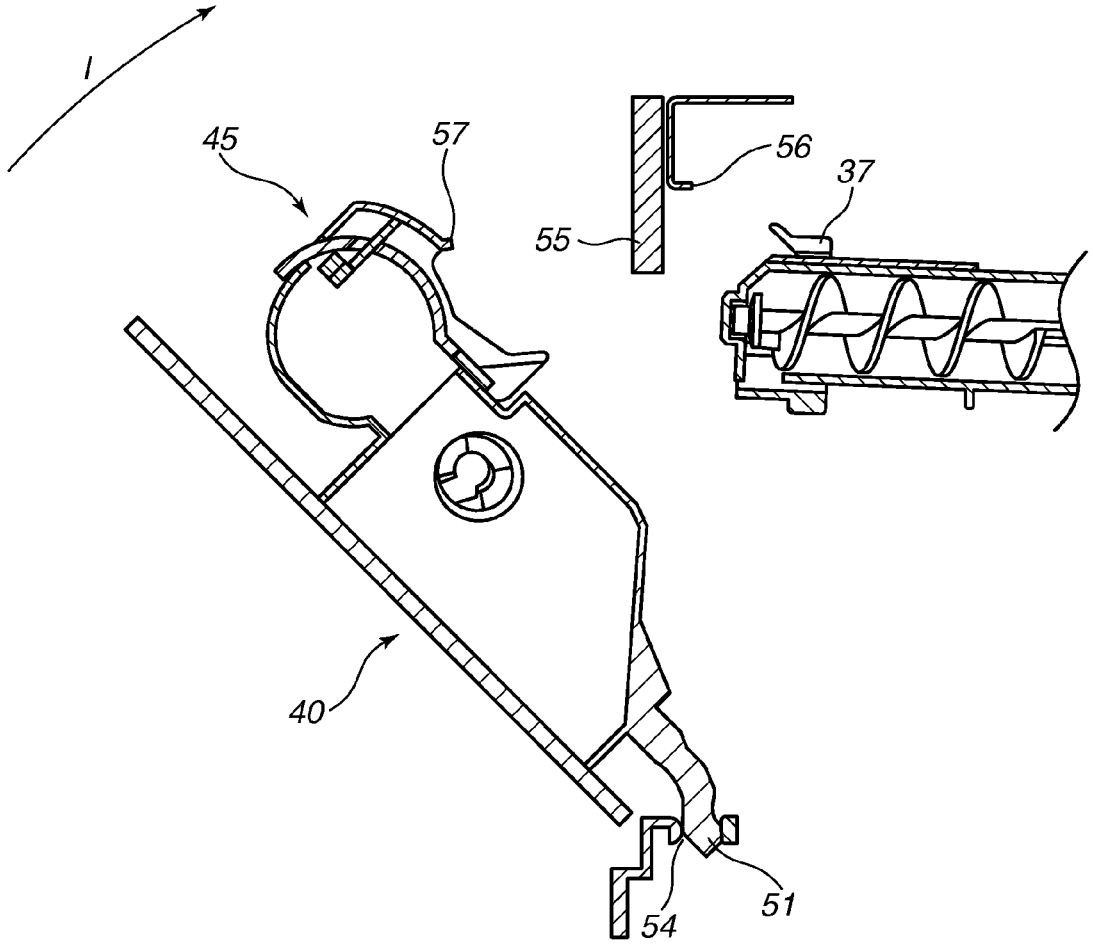
FIG. 10 is a diagram illustrating a process of attaching the toner accommodating container to the image forming apparatus.

Next, a process of attaching the collected toner container 40 to the image forming apparatus 1 will be described in detail with reference to FIGS. 10 to 14. FIG. 10 is a diagram illustrating a state in which attachment of the collected toner container 40 to the image forming apparatus 1 starts. As shown in FIG. 10, the apparatus main body is provided with an apparatus main body engagement portion 54 (aperture), a contact surface 55, and an abutting portion 56. The shutter 45 of the collected toner container 40 includes a rib 57 that is a protrusion member for contacting the contact surface 55. The guide protrusion 51 of the collected toner container 40 can be inserted into and pulled out of the apparatus main body engagement portion 54.

To attach the collected toner container 40 to the apparatus main body, a user or a service person firstly inserts the guide protrusion 51 of the collected toner container 40 into the apparatus main body engagement portion 54 of the apparatus main body, and then pivots the collected toner container 40 in the direction of an arrow I shown in FIG. 10, with the apparatus main body engagement portion 54 serving as a support point for the pivot movement.

Figure 11:
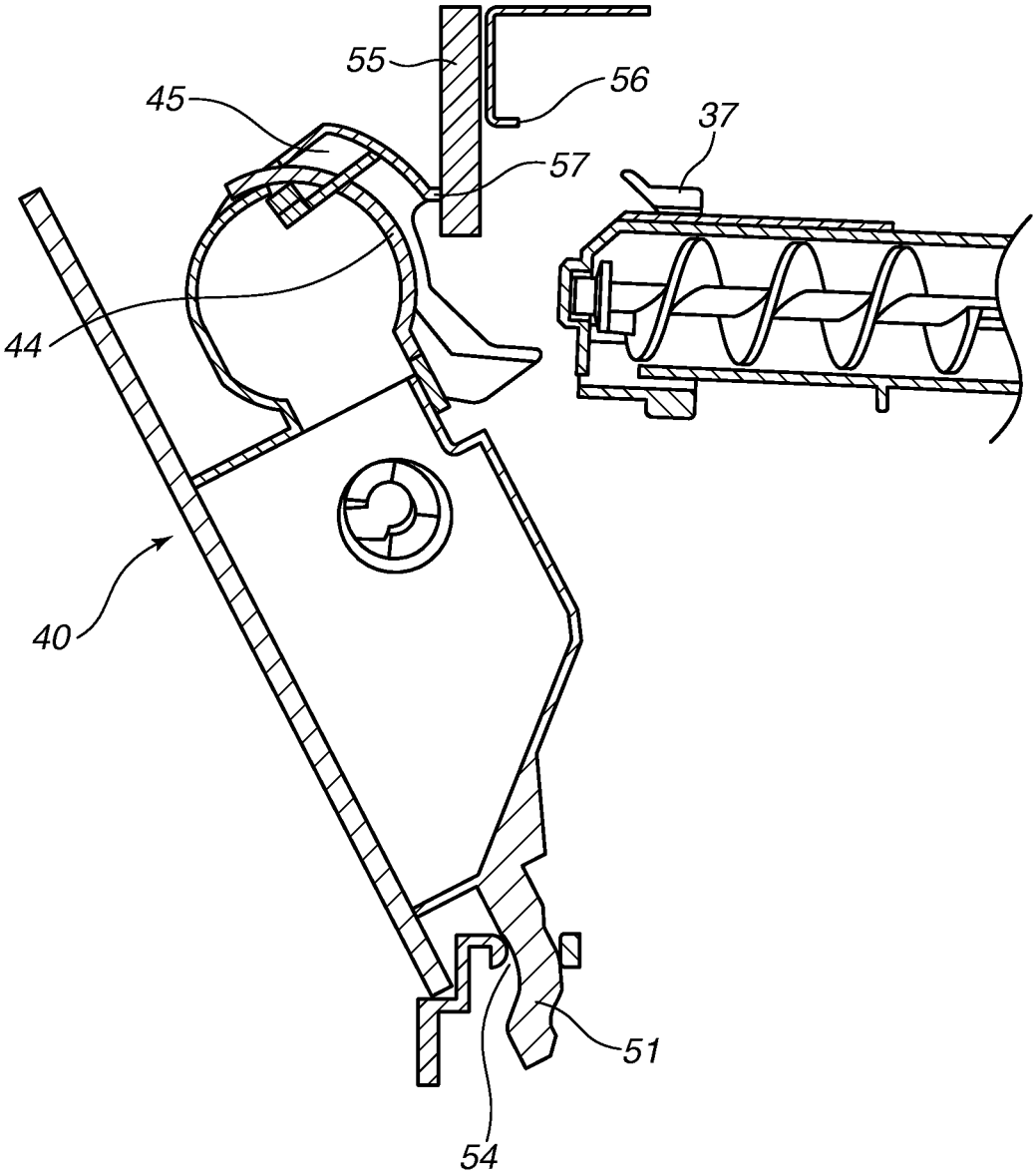
FIG. 11 is a diagram illustrating the process of attaching the toner accommodating container to the image forming apparatus.

FIG. 11 is an illustrative diagram illustrating a state in which the rib (regulating portion) 57 of the shutter 45 is in contact with the contact surface 55 of the apparatus main body. As shown in FIG. 11, the rib 57 contacts the contact surface 55 as a result of pivoting the collected toner container 40 by a predetermined amount from the state shown in FIG. 10. When the rib 57 contacts the contact surface 55, the shutter 45 begins to move in the direction that opens the toner inlet opening 44, with the rib 57 moving upward along the contact surface 55. Thus, it becomes possible to push the collected toner container 40 into the apparatus main body. In the state shown in FIG. 11, the spring 46 urges the shutter 45 in the direction that closes the shutter 45 as illustrated in FIG. 8, so that the urging force from the spring 46 to the shutter 45 is a reaction force against the force for attaching the collected toner container 40 to the apparatus main body.

Figure 12:
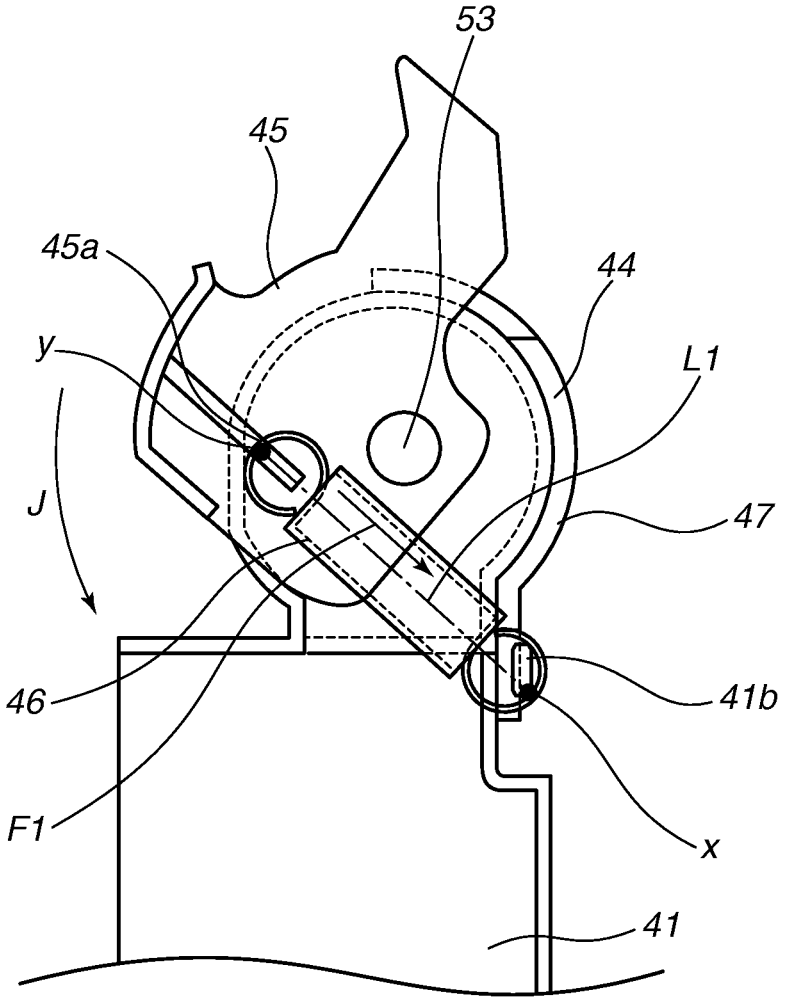
FIG. 12 is a diagram illustrating the process of attaching the toner accommodating container to the image forming apparatus.
Figure 13A:
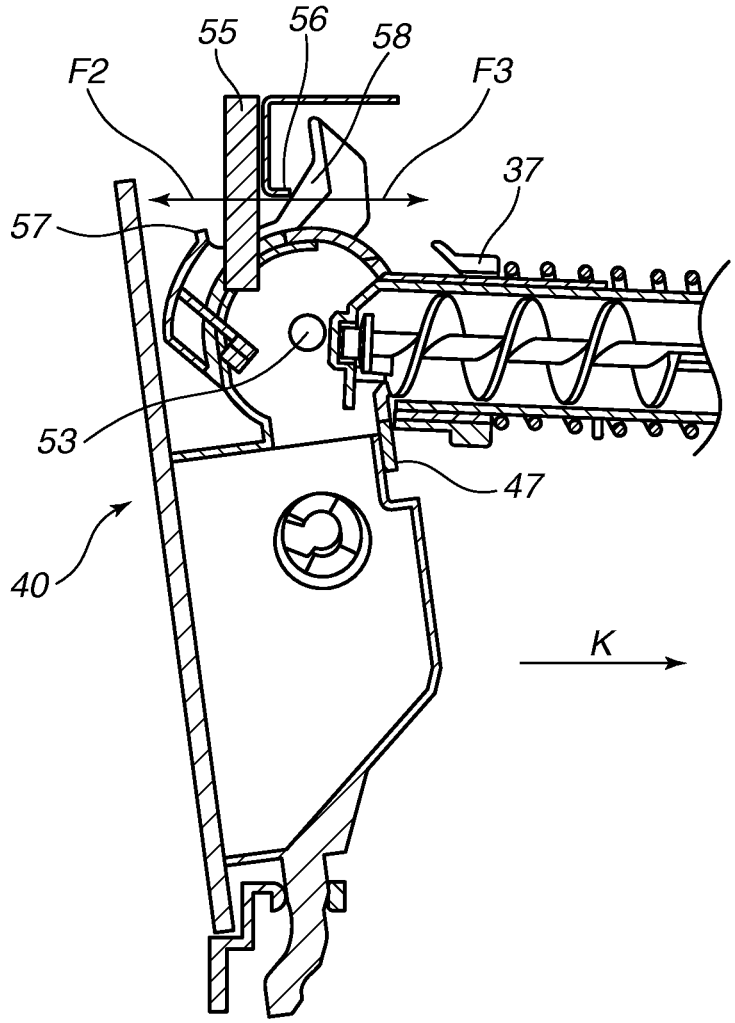
FIGS. 13A and 13B are diagrams illustrating the process of attaching the toner accommodating container to the image forming apparatus.
Figure 13B:
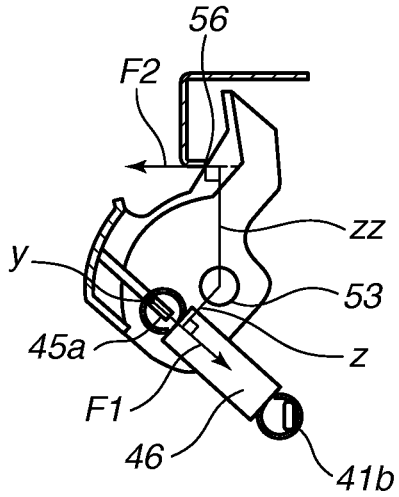

FIG. 12 is a sectional view illustrating a state in which the direction in which the spring 46 urges the shutter 45 has changed from the state shown in FIG. 8. FIGS. 13A and 13B are diagrams illustrating a state in which the spring 46 pulls the collected toner container 40 into the apparatus main body. When the shutter 45 has pivoted by a predetermined amount, the straight line L1, as can be seen from FIG. 12, begins to be located in a left below side of the boss 53 as shown in FIG. 12. At this time, the urging force F1 of the spring 46 (the force pulling the shutter 45) begins to act in a direction that causes the shutter 45 to open the toner inlet opening 44 (in a direction J shown in FIG. 12). More specifically, the urging direction of the spring 46 relative to the shutter 45 changes from the direction E shown in FIG. 8 to the direction J shown in FIG. 12.

After the urging force F1 begins to act in the direction of the arrow J shown in FIG. 12, the rib 57 and the contact surface 55 separate from each other as shown in FIG. 13A. The abutting portion 56 provided in the apparatus main body comes into contact with positioning surface 58 of the shutter 45, which is rotating in the direction J. At this time, the urging force F1 of the spring 46 acts on the collected toner container 40, as a pressing force F2 on the abutting portion 56. Where z represents the length of the normal to the center line of the spring 46 from the center of the boss 53 and zz represents the length of the normal to the abutting portion 56 from the center of the boss 53 (FIG. 13B), a relation of z:zz=1:2 holds.

Therefore, the pressing force F2 is as follows.

$$F2 * zz = F1 * z$$

-continued $$\begin{aligned} F2 &= F1 * z / zz \\ &= 500 * 1/2 \\ &= 250[gf] \end{aligned}$$

The reaction force against the pressing force F2 acts as a pull-in force F3 for the collected toner container 40 in a direction to the apparatus main body, so that the collected toner container 40 begins to be pulled toward the inside of the apparatus main body. Since the pull-in force F3 (that pulls the collected toner container 40 in a direction K in FIG. 13A) is the reaction force against the pressing force F2, a relation of F2=F3 holds.

The magnitude of the urging force F1, the length of the normal z, and the length of the normal zz can be freely set in accordance with the weight of the collected toner container 40, its construction, etc. Even if there is any change in the magnitude of the urging force F1, the length of the normal z, and the length of the normal zz, the effects of the invention do not change. Furthermore, the seal member 47 contacts the slide member 37 and the slide member 37 moves as well. Through this series of actions, the collected toner container 40 is attached to a regular position in the apparatus main body. The positioning of the collected toner container 40 in the apparatus main body in the attaching-detaching direction of the collected toner container 40 is performed when the positioning surface 58 of the collected toner container 40 contacts the abutting portion 56.

Figure 14:
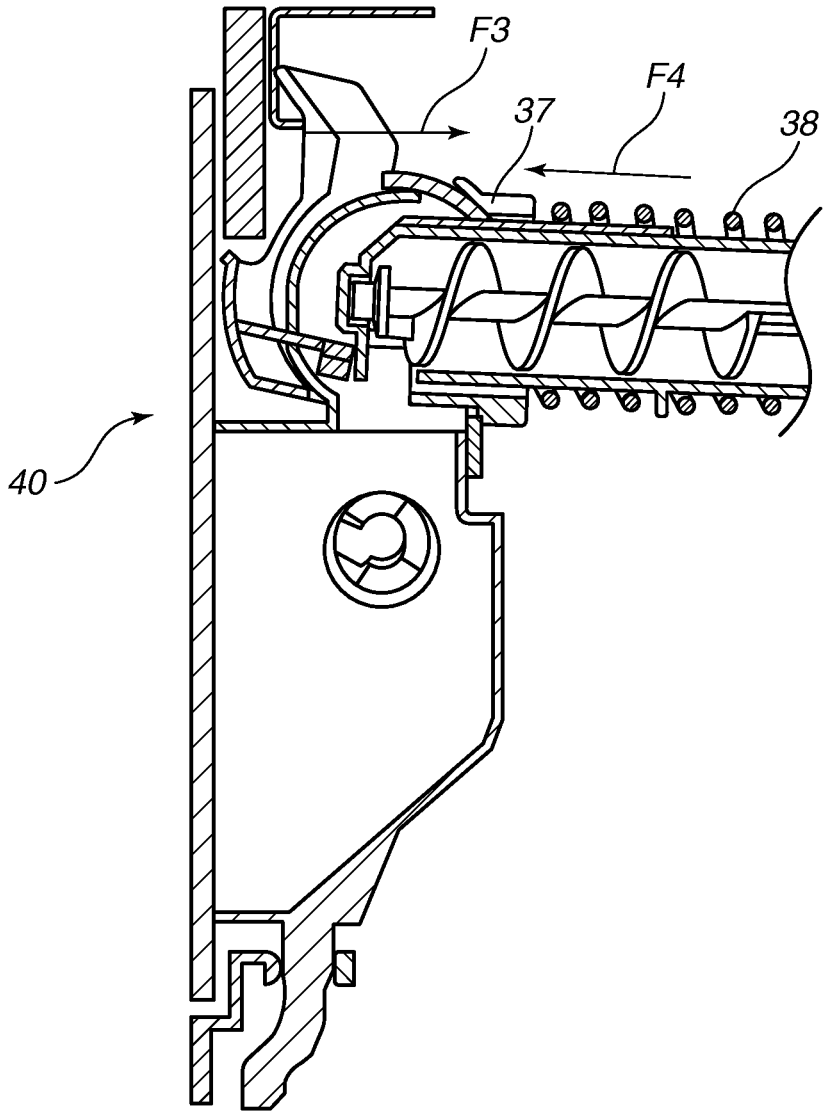
FIG. 14 is a diagram illustrating the process of attaching the toner accommodating container to the image forming apparatus.

FIG. 14 is a sectional view showing a state when the collected toner container 40 is attached to the regular position in the apparatus main body. Setting is made such that when the collected toner container 40 is attached to the regular position in the apparatus main body, the urging force F4 of the spring 38 that acts on the slide member 37 and the pull-in force F3 that acts on the collected toner container have a relation of F3>F4. (In this exemplary embodiment, F3 is 250 [gf], and F4 is 150 [gf].) Therefore, while the collected toner container 40 is attached within the apparatus main body, the collected toner container 40 continues being urged in such a direction that pulls the container 40 into the apparatus main body.

The process of taking the collected toner container 40 out from the image forming apparatus 1 is exactly the reverse of the attaching process. A user or a service person holds the handle 50, and pivots the filled-up collected toner container 40 in the direction of the arrow L shown in FIG. 1. As the straight line L1 defined by the point (x) at which the lug 41*b* contacts the spring 46 and the point (y) at which the spring 46 contacts the lug 45*a* contact begins to be located in the right side of the boss 53 as in FIG. 8, the spring 46 begins to urge the shutter 45 in the direction that causes the shutter 45 to close the toner inlet opening 44 (in the direction of the arrow E shown in FIG. 8). As the user or service person further pivots the collected toner container 40, the shutter 45 completely closes the toner inlet opening 44. After fully pivoting the collected toner container 40 away from the apparatus main body, the user or service person pulls the guide protrusion 51 off from the apparatus main body engagement portion 54, and then takes the collected toner container 40 out of the apparatus main body.

In this manner, the urging direction of the spring 46 relative to the shutter 45 of the collected toner container 40 can be changed in connection with the movement of the shutter 45 when the collected toner container 40 is attached to the apparatus main body. When the collected toner container 40 is attached to the apparatus main body, the urging force of the spring 46 acting on the shutter 45 can be utilized to pull the collected toner container 40 into the apparatus main body. Therefore, when the collected toner container 40 is attached to the apparatus main body, the urging force of the spring 46 can be prevented from always being a reaction force against the force for attaching the collected toner container 40 to the apparatus main body. Thus, the ease of the operation of attaching the collected toner container 40 to the apparatus main body can be improved. Furthermore, there is no need to provide a dedicated member designed specifically to pull the collected toner container 40 into the apparatus main body.

Furthermore, since the shutter 45 also serves as a pull-in member, the shutter 45 pulls the collected toner container 40 into the apparatus main body simultaneously with opening of the toner inlet opening 44. Therefore, the scattering of toner from the toner discharge opening 36 to the inside of the apparatus main body and occurrence of improper passage of toner from the toner discharge opening 36 to the toner inlet opening 44 can be more effectively suppressed and controlled.

Figure 15:
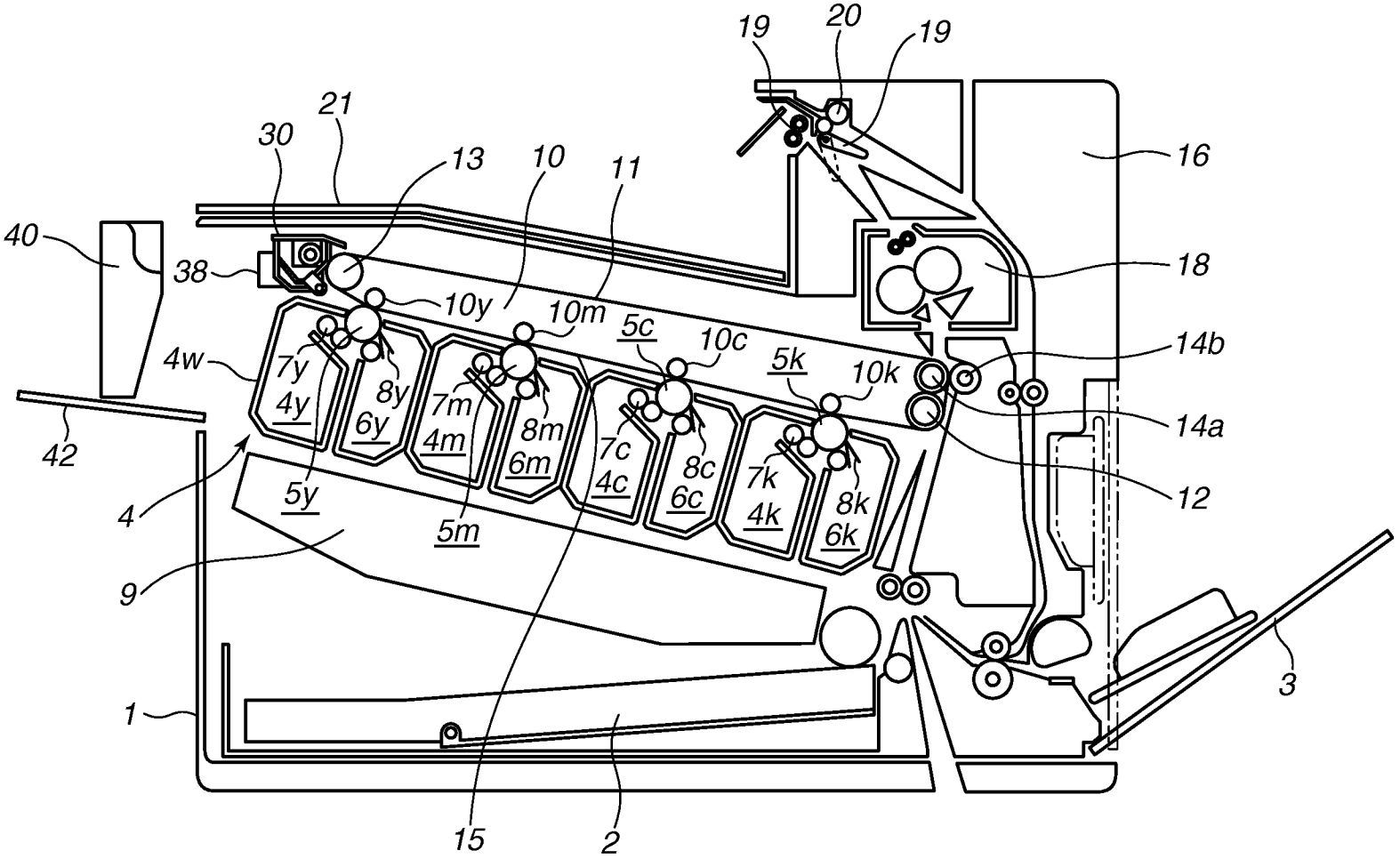
FIG. 15 is a sectional view of an image forming apparatus illustrating a modification of the first exemplary embodiment.

Furthermore, the present invention is also applicable to a construction in which the collected toner container 40 and the exterior cover 42 are separate as shown in FIG. 15.

Hereinafter, a second exemplary embodiment will be described. The first exemplary embodiment is described above in conjunction with the construction in which the collected toner container 40 is attached to the apparatus main body by pivoting the collected toner container 40 about the guide protrusion 51. In contrast, the second exemplary embodiment has a feature that the collected toner container 40 is attached to the apparatus main body by sliding the collected toner container 110 relative to the apparatus main body. Other constructions and the like in the second exemplary embodiment are substantially the same as those of the image forming apparatus in the first exemplary embodiment, and therefore comparable portions are denoted by the same reference characters in the following description.

Figure 16:
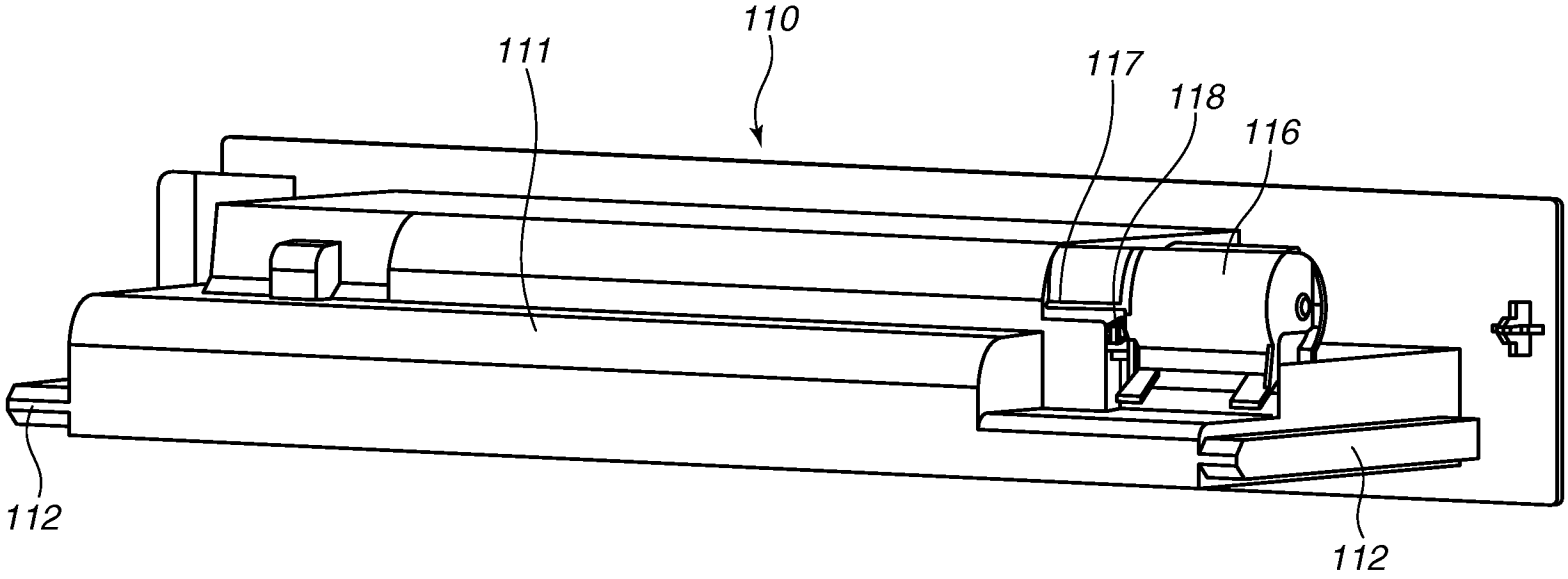
FIG. 16 is a diagram illustrating a toner accommodating container that has been removed from an image forming apparatus in a second exemplary embodiment.
Figure 17:
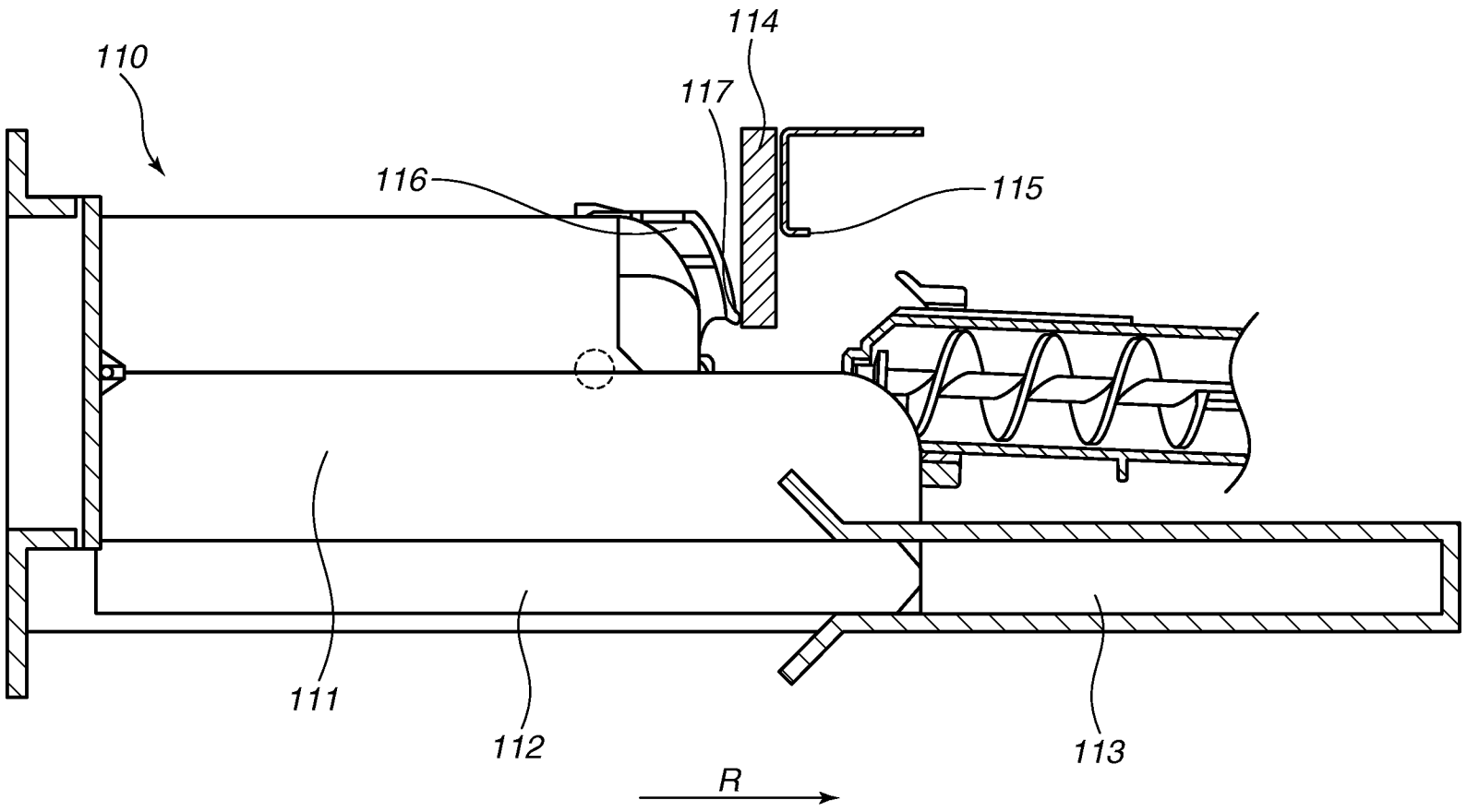
FIG. 17 is a diagram illustrating the toner accommodating container that is being attached to the image forming apparatus in the second exemplary embodiment.

FIG. 16 is a diagram showing a state of a collected toner container 110 when the collected toner container 110 is detached from an image forming apparatus. FIG. 17 is a diagram showing a state when the collected toner container 110 is attached to the apparatus main body.

As shown in FIG. 16, the collected toner container 110 of this exemplary embodiment includes guide ribs (guide portions) 112 provided on two opposite side wall surfaces of an accommodation portion 111. A spring 118 is provided corresponding to the spring 46 in the first exemplary embodiment, and a shutter 116 and a rib 117 are provided corresponding to the shutter 45 and the rib 57, respectively. Other component parts that constitute the collected toner container 110 are substantially the same as those in the first exemplary embodiment, and therefore will not be described below. As shown in FIG. 17, the apparatus main body is provided with groove portions 113 that guide the guide ribs 112, a contact surface 114 that contacts the rib 117, and an abutting portion 115.

A user or a service person engages the guide ribs 112 with the groove portions 113, and then slides the collected toner container 110 in the direction of an arrow R shown in FIG. 17. When the collected toner container 110 slides by a predetermined amount, the rib 117 provided on the shutter 116 contacts the contact surface 114. Then, as the shutter 116 further pivots, the shutter 116 begins to open. At this time, the relation between the urging direction of the spring 118 (FIG. 16) and the pivoting direction of the shutter 116, and subsequent pivoting action of the shutter 116, and the pulling-in action for the collected toner container 110 are substantially the same as in the first exemplary embodiment. Finally, the collected toner container 110 is attached to a regular position within the apparatus main body, and the collected toner container 110 is urged in a direction that pulls the container 110 into the apparatus main body (the direction of the arrow R shown in FIG. 17). With regard to taking the collected toner container 110 out of the apparatus main body, the secondary exemplary embodiment is substantially the same as the first exemplary embodiment, except that the guide ribs 112 slide in the groove portions 113 in the direction opposite to the direction of the arrow R shown in FIG. 17 when the collected toner container 110 is taken out.

This construction makes it possible to attach the collected toner container 110 to the apparatus main body in a state in which the collected toner container 110 is guided within the apparatus main body by the groove portions 113, so that the collected toner container 110 can be more reliably attached.

The first and second exemplary embodiments have been described in conjunction with the collected toner container which contains toner collected from the intermediate transfer belt unit. The present invention is also applicable to a collected toner container that contains toner collected from the photosensitive drums of the process cartridges. Furthermore, the present invention is also applicable to a collected toner container that contains both toner collected from the belt unit and toner collected from the photosensitive drums. Still further, the present invention is also applicable to not only collected toner containers but also a toner accommodating container for supplying fresh toner to an apparatus main body. In that case, the opening of the toner accommodating container may also be used as a toner supply opening for supplying toner to the apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A toner accommodating container attachable to and detachable from an image forming apparatus, the toner accommodating container comprising:

an accommodation portion that contains toner;

an opening portion;

an opening-closing member movable to open and close the opening portion; and an urging member that urges the opening-closing member so that the opening-closing member closes the opening portion in a state in which the toner accommodating container is detached from the image forming apparatus, wherein the toner accommodating container is pulled into a main body of the image forming apparatus by using the urging force of the urging member in a case where the detached toner accommodating container from the image forming apparatus is attached to the image forming apparatus.

2. The toner accommodating container according to claim 1, wherein in a case where the toner accommodating container is attached to the image forming apparatus, the opening-closing member contacts the image forming apparatus so that the opening-closing member moves from a state in which the opening-closing member is closing the opening portion.

3. The toner accommodating container according to claim 1, wherein the opening-closing member pivots about a pivot axis.

4. The toner accommodating container according to claim 3, wherein the urging member is a spring, and an end of the spring is held at a first latching portion provided in the accommodation portion.

5. The toner accommodating container according to claim 4, wherein the opening-closing member includes a second latching portion at which another end of the spring is held, and wherein the urging direction of the spring relative to the opening-closing member is changed by pivoting of the opening-closing member as a position of the second latching portion changes relative to the pivot axis.

6. The toner accommodating container according to claim 1, wherein the toner accommodating container is positioned relative to the image forming apparatus by the opening-closing member contacting an abutting portion provided in the image forming apparatus.

7. The toner accommodating container according to claim 1, wherein the toner accommodating container is a container in which toner collected in the image forming apparatus flows via the opening into and is contained in the accommodation portion.

8. The toner accommodating container according to claim 1, wherein the toner accommodating container includes a cover, and the cover is a part of an exterior cover that forms an exterior of the image forming apparatus.

9. The toner accommodating container according to claim 1, further comprising a protrusion portion that can be inserted into and drawn out of an aperture provided in the image forming apparatus, wherein in a case where the toner accommodating container is attached to the image forming apparatus, the protrusion portion is inserted into the aperture and then the toner accommodating container is pivoted with the aperture serving as a pivot support point to be attached to the image forming apparatus.

10. The toner accommodating container according to claim 1, wherein the toner accommodating container includes a guide portion, and the guide portion can engage with a groove portion that is provided in the image forming apparatus, and wherein in a case where the toner accommodating container is attached to the image forming apparatus, the guide portion engages with the groove portion and the toner accommodating container slides along the groove portion to attach the toner accommodating container to the image forming apparatus.

11. An image forming apparatus comprising:

an apparatus main body; and the toner accommodating container according to claim 1 being attachable to and detachable from the apparatus main body.

12. The image forming apparatus according to claim 11, further comprising a cleaning unit that collects toner from a member of the apparatus main body, wherein the opening portion is an inlet opening through which the toner from the cleaning unit flows into the accommodation portion.

13. The image forming apparatus according to claim 11, wherein the toner accommodating container includes a cover, and the cover is a part of an exterior cover that forms an exterior of the apparatus main body.

14. The image forming apparatus according to claim 13, further comprising:

an image carrier that carries a toner image; and a belt unit including a belt configured to transfer the toner image from the image carrier to a transfer material, the cleaning unit collecting the toner from the belt.

* * * * *